US007007879B2

(12) United States Patent
Virving

(10) Patent No.: US 7,007,879 B2
(45) Date of Patent: Mar. 7, 2006

(54) PAIR OF OPPOSED CO-OPERATING REFINING ELEMENTS

(75) Inventor: Nils Virving, Hässelby (SE)

(73) Assignee: Metso Paper, Inc., (FI)

( * ) Notice: Subject to any disclaimer, the term of this patent is extended or adjusted under 35 U.S.C. 154(b) by 168 days.

(21) Appl. No.: 10/467,880

(22) PCT Filed: Jan. 29, 2002

(86) PCT No.: PCT/SE02/00147

§ 371 (c)(1),
(2), (4) Date: Feb. 11, 2004

(87) PCT Pub. No.: WO02/064259

PCT Pub. Date: Aug. 22, 2002

(65) Prior Publication Data

US 2004/0118959 A1 Jun. 24, 2004

(30) Foreign Application Priority Data

Feb. 15, 2001 (SE) ..... 0100540

(51) Int. Cl.
*B02C 7/12* (2006.01)

(52) U.S. Cl. ..... 241/261.2; 241/298

(58) Field of Classification Search ..... 241/261.2, 241/261.1, 298

See application file for complete search history.

(56) References Cited

U.S. PATENT DOCUMENTS 5,425,508 A * 6/1995 Chaney ..... 241/261.2
5,934,585 A * 8/1999 Chaney ..... 241/298
5,950,946 A * 9/1999 Kjellqvist et al. ..... 241/261.2
6,311,907 B1 * 11/2001 Gingras ..... 241/28
6,325,308 B1 * 12/2001 Lofgren et al. ..... 241/28
6,422,496 B1 * 7/2002 Doelle ..... 241/261.2
6,607,153 B1 * 8/2003 Gingras ..... 241/261.3
2002/0070303 A1 * 6/2002 Johansson et al. ..... 241/261.3

FOREIGN PATENT DOCUMENTS

SE 505 395 A1 8/1997

* cited by examiner

*Primary Examiner*—Derris H. Banks
*Assistant Examiner*—Faye Francis
(74) *Attorney, Agent, or Firm*—Lerner, David, Littenberg, Krumholz & Mentlik, LLP

(57) ABSTRACT

Apparatus for refining lignocellulosic material is disclosed having a pair of opposed co-operating refining elements intended for a disk refiner for the disintegration of the lignocellulosic material in a refining gap between two opposed counter-rotating refining disks. The refining elements are intended to be placed directly in front of each other on opposed refining disks, and both refining elements are formed with refining surfaces with bars and grooves. In order to prevent generated steam from flowing rearward in the refining gap, a first refining element is formed with a first radially restricted zone with elevated bars and a second radially restricted zone without bars directly outside the first zone. A second opposed refining element is formed with a third radially restricted zone without bars, which third zone is located directly in front of the first and the second zone on the first refining element.

8 Claims, 1 Drawing Sheet

PAIR OF OPPOSED CO-OPERATING REFINING ELEMENTS

FIELD OF THE INVENTION

The present invention relates to the disintegration and refining of lignocellulosic material, such as mechanical pulp (TMP, CTMP), reject pulp, recycled fiber pulp and the like in a disk refiner with planar or angled disks. More particularly, the present invention relates to refiner elements for use in a refiner of this kind.

BACKGROUND OF THE INVENTION

A disk refiner comprises two opposed counter-rotating refining disks, one or both of which are rotary within a surrounding refiner housing. A plurality of refining elements is arranged on the refining disks. A refining element can also be assembled from several partial elements. These refining elements are formed with a pattern of bars and intermediate grooves. The refining disks are located in such a way that the refining elements form a refining gap, through which, the fiber material is intended to pass from the inside out, and during that passage the disintegration is carried out by the bars of the elements. These bars can be of different designs. They can be continuous or discontinuous, with uniform or varying height. In certain cases toothed bars can be used.

In the refining gap between the refining surfaces the fiber material is first defibered, i.e. the fibers are separated. This takes place in the interior portion of the refining gap, where there is the greatest distance between the refining surfaces. The refining gap decreases thereafter outwardly, and at the same time the pattern of the bars becomes tighter in order to obtain the desired working of the fiber material. Large amounts of energy are required to achieve this working. The material concentration can be from about 3% to 50%, which generates large amounts of steam from the water following therealong.

Part of the generated steam flows rearwardly inward to the inlet for the material, and another portion flows forwardly outward to the outlet from the refining gap. The steam pressure increases from the inlet to a pressure maximum in the outer portion of the refining gap, and thereafter decreases toward the outlet. This maximum pressure, which can rise to from about 7 to 8 bar, causes the steam generated in the refining gap outside the pressure maximum to flow outward, while the steam inside the pressure maximum flows inward. The rearward flowing steam causes a disturbance in the fiber flow in the refining gap. This is inconvenient, because a non-uniform fiber flow results in uneven pulp quality.

Depending on the desired degree of working and, thus, pulp quality, the refining surfaces are given a different design. Other factors also influence the pulp quality, for example the size of the refining gap, the moisture content of the fiber material, the feed, the temperature, and other such factors.

SUMMARY OF THE INVENTION

In accordance with the present invention, these and other objects have now been realized by the discovery of apparatus for refining lignocellulosic material comprising a first refining element adapted for mounting on a first refiner disk, and a second refining element adapted for mounting on a second refiner disk juxtaposed with the first refiner disk, the first and second refiner disks adapted for relative rotation with respect to each other whereby a refining gap is created between the first and second refining elements mounted on the first and second refiner disks, the first refining element including a first radially projecting refining surface including a first inner refining zone including a plurality of raised bars separated by a plurality of grooves therebetween, a second restricted radial refining zone disposed radially outward of the first inner refining zone and including a plurality of raised bars, a third restricted radial refining zone disposed radially outward of the second restricted refining zone and being devoid of any raised bars, and a fourth restricted radial refining zone disposed radially outward of the third restricted radial refining zone and including a plurality of raised bars separated by a plurality of grooves therebetween, and the second refining element including a second radial refining surface having a fifth inner radial refining zone including a plurality of raised bars separated by a plurality of grooves therebetween, a sixth restricted radial refining zone disposed radially outward of the fifth inner radial refining zone and being devoid of any raised bars, and a seventh radial refining zone disposed radially outward of the sixth restricted radialy refining zone and including a plurality of raised bars separated by a plurality of grooves therebetween, the sixth restricted radial refining zone being located in direct juxtaposition with the second restricted radial refining zone.

In accordance with one embodiment of the apparatus of the present invention, the plurality of raised bars and the plurality of grooves in the fourth radial refining zone and the seventh radial refining zone directly abut the third restricted radial refining zone and the sixth restricted radial refining zone, respectively.

In another embodiment of the apparatus of the present invention, the first refining element includes a first circumferentially extending ridge disposed radially outward of the third restricted radial refining zone.

In another embodiment of the apparatus of the present invention, the second refining element includes a second circumferentially extending ridge disposed radially outward of the sixth restricted radial refining zone.

In accordance with another embodiment of the apparatus of the present invention, at least one of the third and sixth restricted radial refining zones includes an uneven surface.

In accordance with another embodiment of the apparatus of the present invention, the plurality of raised bars in the second restricted radial refining zone are disposed at an angle between 0° and 60° with respect to the radius of the first refining element.

In accordance with another embodiment of the apparatus of the present invention, each of the first and second refining elements comprises a single element extending radially along the entire refining gap. In yet another embodiment, each of the first and second refining elements comprises at least two partial refining elements extending in sequence radially along the entire refining gap.

In accordance with the present invention, the refining elements are formed so, that the main part of the steam generated in the refining gap is prevented from flowing rearwardly inward in the refining gap, but instead flows forwardly outward. This is achieved by the bars of the refining elements being formed in such a way that the material in the refining gap forms a steam lock, which moves the pressure maximum inward in the refining gap. Due to the fact that the main part of the steam flows outward together with the material, disturbances in the fiber flow are minimized, and the quality of the pulp will be higher and more uniform.

BRIEF DESCRIPTION OF THE DRAWINGS

The present invention is described in greater detail in the following detailed description, which, in turn, refers to the accompanying Figures, in which.

DETAILED DESCRIPTION

Figure 1:
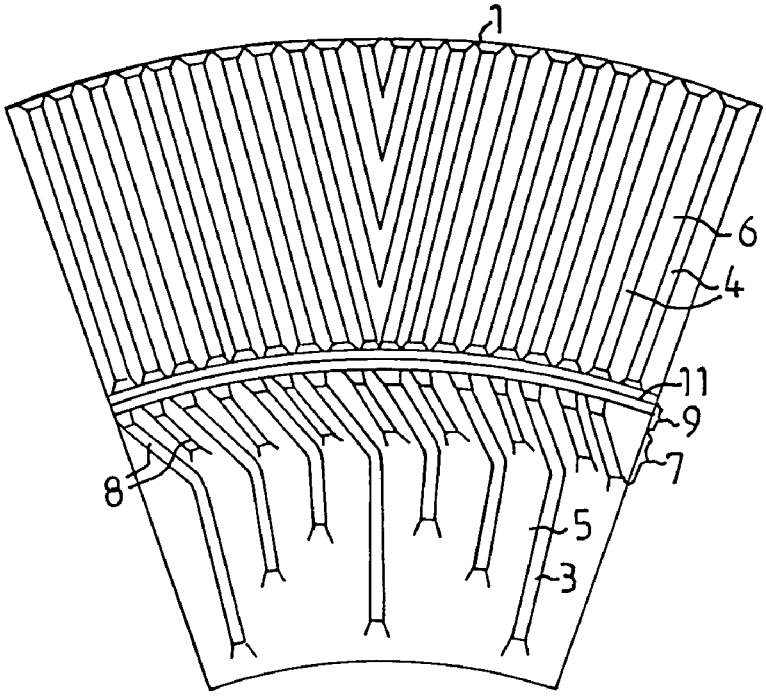
FIG. 1 is a top, elevational view of a refining surface on the two co-operating refining elements according to the present invention.
Figure 3:
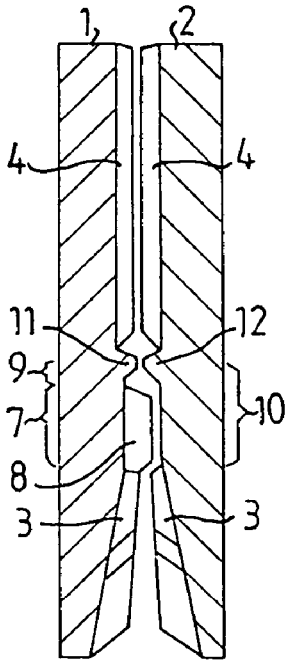
FIG. 3 is a side, elevational, cross-sectional view of the two refiner elements of the present invention.
Figure 2:
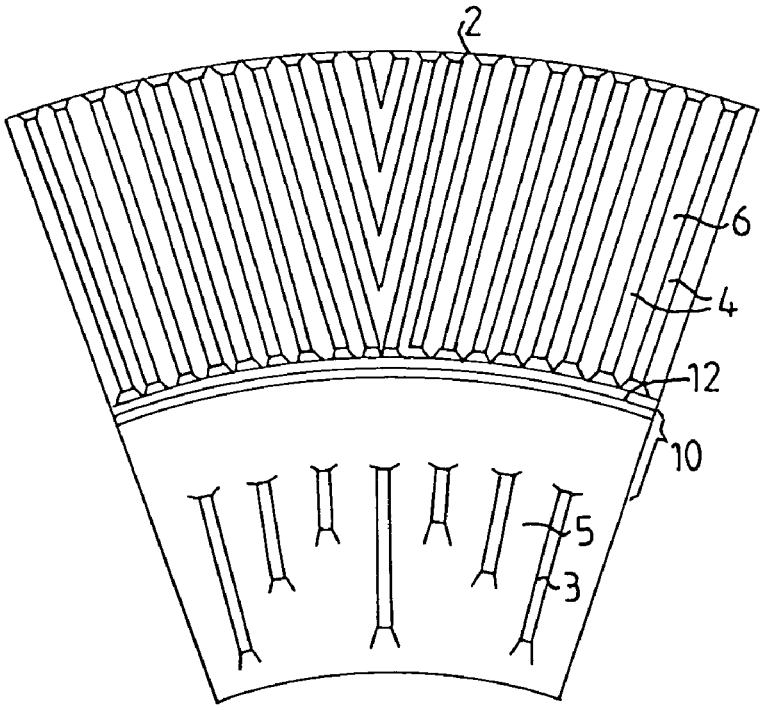
FIG. 2 is a top, elevational view of the other refining surface according to the present invention.

Each of the opposed co-operating refining elements, 1 and 2, according to the present invention consists of a single element, which extends radially along the entire refining gap, or of at least two partial elements, each of which extends radially, one after the other, along a portion of the refining gap.

Each of the refining surfaces of the co-operating refining elements, 1 and 2, is provided with bars, 3 and 4, and intermediate grooves, 5 and 6. The first refining element 1, which is intended to be placed on a rotary refining disk, is formed with a first radially restricted zone 7 with elevated bars 8 located in the inner portion of the refining gap. Directly outside this first zone 7, a second radially restricted zone 9 without bars is located. This zone 9, instead of having bars, can be formed smooth or with an uneven surface which is intended to bring about a certain braking effect on the material in the refining gap. The second refining element 2, which is intended to be placed directly in front of the first refining element 1 on a stationary or rotary refining disk, is formed with a third radially restricted zone 10 without bars. This third zone 10 is located directly in front of the first zone 7 and the second zone 9. The third zone does not have bars, but can be smooth or can be formed with unevennesses or the like intended to bring about a certain braking effect on the material in the refining gap. Outside these restricting zones, 7, 9 and 10, both refining elements, 1 and 2, are provided with bars 4 and grooves 6, which can have a conventional design. One refining element can possibly be formed with an elevated ridge, 11, 12, which extends in the circumferential direction after the second and third zones, 9 and 10, respectively.

The elevated bars 8 in the first zone 7 on the first refining element 1 extend into the third zone 10 on the second refining element 2, so that the tops of the bars 8 are located close to the surface of the refining element 2 in the third zone 10. The elevated bars 8 are suitably angled in relation to the radius of the refining element 1, so that they extend outward rearwardly, as seen in the direction of rotation of the refining element. The angle should be between about 0° and 60°, suitably between 10° and 45°.

During the refining operation, the material is fed from the inside out through the refining gap formed between the two opposed refining elements, 1 and 2. In the innermost portion of the refining gap a first working of the material takes place, which is defibered without any considerable generation of steam. The material arrives thereafter at the restricted zones, 7, 9 and 10, where the material by the elevated bars 8 on the first rotating refining element 1 will be caused to rotate while at the same time, by the centrifugal force, being fed outwardly. When the elevated bars 8 are angled, the feeding effect is increased. In the space defined by the second zone 9 and the opposed third zone 10 there are no bars, which implies that the material is collected in the form of an all-around material ring, which outwardly is braked by the bars 4 and/or ridges, 11 and 12, on the refining elements, 1 and 2. The material ring formed in this way is an effective flow obstacle for the steam generated during the working of the material between the bars 4 in the refining gap outside of the material ring. The unevennesses, which can be arranged in the second and third zones 9 and 10, have a certain braking effect on the material, which can facilitate the formation of the material ring in the space defined by the zones 9 and 10.

When the material is fed into the refining gap at a pressure of, for example, about 1 bar, and the pressure in the surrounding refining housing, for example, is about 3 bar, then there arises in the refining gap a pressure maximum, which can amount to about 8 bar. This pressure maximum, according to the present invention, can be moved to the radial position, which is defined by the material ring formed in the refining gap in the space defined by the second radially restricted zone 9 in the first refining element 1 together with the portion of the third radially restricted zone 10 located directly in front of the second refining element 2. The steam generated in the refining gap outside the material ring is then forced to flow outwardly together with the material, whereby the working and material flow become more uniform and, thus, the pulp quality is improved and made more uniform.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. Apparatus for refining lignocellulosic material comprising a first refining element adapted for mounting on a first refiner disk, and a second refining element adapted for mounting on a second refiner disk juxtaposed with said first refiner disk, said first and second refiner disks adapted for relative rotation with respect to each other whereby a refining gap is created between said first and second refining elements mounted on said first and second refiner disks, said first refining element including a first radially projecting refining surface including a first inner refining zone including a plurality of raised bars separated by a plurality of grooves therebetween, a second restricted radial refining zone disposed radially outward of said first inner refining zone and including a plurality of raised bars, a third restricted radial refining zone disposed radially outward of said second restricted refining zone and being devoid of any raised bars, and a fourth restricted radial refining zone disposed radially outward of said third restricted radial refining zone and including a plurality of raised bars separated by a plurality of grooves therebetween, and said second refining element including a second radial refining surface having a fifth inner radial refining zone including a plurality of raised bars separated by a plurality of grooves therebetween, a sixth restricted radial refining zone disposed radially outward of said fifth inner radial refining zone and being devoid of any raised bars, and a seventh radial refining zone disposed radially outward of said sixth restricted radialy refining zone and including a plurality of raised bars separated by a plurality of grooves therebetween, said sixth restricted radial refining zone being located in direct juxtaposition with said second restricted radial refining zone.

2. The apparatus of claim 1 wherein said plurality of raised bars and said plurality of grooves in said fourth radial refining zone and said seventh radial refining zone directly abut said third restricted radial refining zone and said sixth restricted radial refining zone, respectively.

3. The apparatus of claim 1 wherein said first refining element includes a first circumferentially extending ridge disposed radially outward of said third restricted radial refining zone.

4. The apparatus of claim 1 wherein said second refining element includes a second circumferentially extending ridge disposed radially outward of said sixth restricted radial refining zone.

5. The apparatus of claim 1 wherein at least one of said third and sixth restricted radial refining zones includes an uneven surface.

6. The apparatus of claim 1 wherein said plurality of raised bars in said second restricted radial refining zone are disposed at an angle between 0° and 60° with respect to the radius of said first refining element.

7. The apparatus of claim 1 wherein each of said first and second refining elements comprises a single element extending radially along said entire refining gap.

8. The apparatus of claim 1 wherein each of said first and second refining elements comprises at least two partial refining elements extending in sequence radially along said entire refining gap.

* * * * *